US005465837A

United States Patent [19]

Focke

[11] Patent Number: 5,465,837

[45] Date of Patent: Nov. 14, 1995

[54] PACKS FOR CIGARETTES

[75] Inventor: Heinz Focke, Verden, Germany

[73] Assignee: Focke & Co. (GmbH & Co.), Verden, Germany

[21] Appl. No.: 120,428

[22] Filed: Sep. 14, 1993

[30] Foreign Application Priority Data

Sep. 21, 1992 [DE] Germany ..... 42 31 591.3

[51] Int. Cl.[6] ..... B65D 85/10

[52] U.S. Cl. ..... 206/268; 206/271

[58] Field of Search ..... 206/265, 268, 206/271, 273; 229/87.13, 160.1

[56] References Cited

U.S. PATENT DOCUMENTS

| | | | |
|---|---|---|---|
| 1,895,932 | 1/1933 | Koch | 229/87.13 |
| 2,984,384 | 5/1961 | Chalmers et al. | 229/87.13 |
| 4,303,155 | 12/1981 | Focke et al. | 206/273 |
| 4,732,276 | 3/1988 | Knecht | 206/273 |
| 4,784,261 | 11/1988 | Kutchin | 206/271 |
| 4,938,363 | 3/1990 | Amendola . | |
| 4,949,841 | 8/1990 | Focke et al. | 206/273 |
| 5,137,148 | 8/1992 | Evers | 206/273 |
| 5,160,024 | 11/1992 | Evers | 206/271 |

FOREIGN PATENT DOCUMENTS

| | | |
|---|---|---|
| 0214413 | 3/1987 | European Pat. Off. . |
| 0443787 | 8/1991 | European Pat. Off. . |
| 0476882 | 3/1992 | European Pat. Off. . |
| 1018816 | 1/1953 | France . |
| 7824117 | 3/1979 | Germany . |
| 3036854 | 5/1982 | Germany . |
| 3322129 | 12/1984 | Germany . |
| 3529119 | 2/1987 | Germany . |
| 3634489 | 4/1987 | Germany . |
| 3806818 | 9/1989 | Germany . |
| 9112727 | 1/1992 | Germany . |
| 2238770 | 6/1991 | United Kingdom . |

*Primary Examiner*—Jimmy G. Foster
*Attorney, Agent, or Firm*—Abelman, Frayne & Schwab

[57] ABSTRACT

A cigarette pack of the hinged-lid type is provided with an inner wrapping [21] which provides a pull-off flap [34] located in the region of the front wall [26] of the pack, the pull-off flap being provided with printed matter, and being larger than is usual, preferably the pull-off flap is provided by a perforation line [35] placed lower than an upper edge of the front wall [26].

4 Claims, 5 Drawing Sheets

PACKS FOR CIGARETTES

DESCRIPTION

The invention relates to a pack for cigarettes, especially a hinge-lid packet, with an inner wrapping made of paper or paper-like material for a cigarette group, the inner wrapping possessing, in the region of a front wall, a pull-off flap limited by a transversely directed perforation line.

Packs of the hinge-lid type are in widespread use for cigarettes. The constructive design of a pack of this type is largely standard internationally. The hinge-lid packet itself consists of a packet part with a lid arranged on a packet rear wall and with a collar arranged in the packet part. The collar projects with an upper portion out of the packet part. The free part of the collar is surrounded by the lid in the closing position of the hinge-lid packet.

The pack content, namely the cigarette group, is surrounded by an inner wrapping. This forms a pull-off flap which can be removed when the pack is used. The invention is predominantly concerned with this pull-off flap.

The object of the invention is to provide the pull-off flap of the inner wrapping for an additional purpose.

In the solution for achieving this object, the pull-off flap serves, in the region of its front side, as a carrier for an imprint, especially for advertising purposes, as a voucher, etc. At least one part face of the front side of the pull-off flap, but preferably the entire front side of a front wall of the pull-off flap, is provided with an imprint consisting of word and/or picture constituents. The content of the imprint can take the form of advertising. However, the pull-off flap designed in this way is especially suitable as a voucher, certificate of entitlement to participation in competitions, announcements, etc.

According to a further feature of the invention, the pull-off flap is markedly enlarged in order to perform the foregoing function. This is achieved in that the perforation line limiting the pull-off flap at the bottom is taken further downwards to a bottom of the pack. At all events, in the invention, the perforation line or the lower limitation of the pull-off flap is located below the collar, but above an oblique folding edge of a side tab of the pull-off flap. The front wall of the pull-off flap and also its front side as a carrier for the imprint are thereby markedly enlarged.

According to the invention, the imprint is applied to a material web before blanks for the inner wrapping are produced from the latter. The material for the inner wrapping is therefore at least partially finished when the blanks for the inner wrapping are formed by being severed from the material web.

For specific instances of use, especially when the pull-off flap is used as a voucher or other document, according to the invention the imprint or a part marking of the latter is applied in the region of the packaging machine, so that the imprint is marked effectively only immediately upon the finishing of the pack.

Further particulars of the invention are explained in more detail below by means of an exemplary embodiment. In the drawing.

Figure 1:
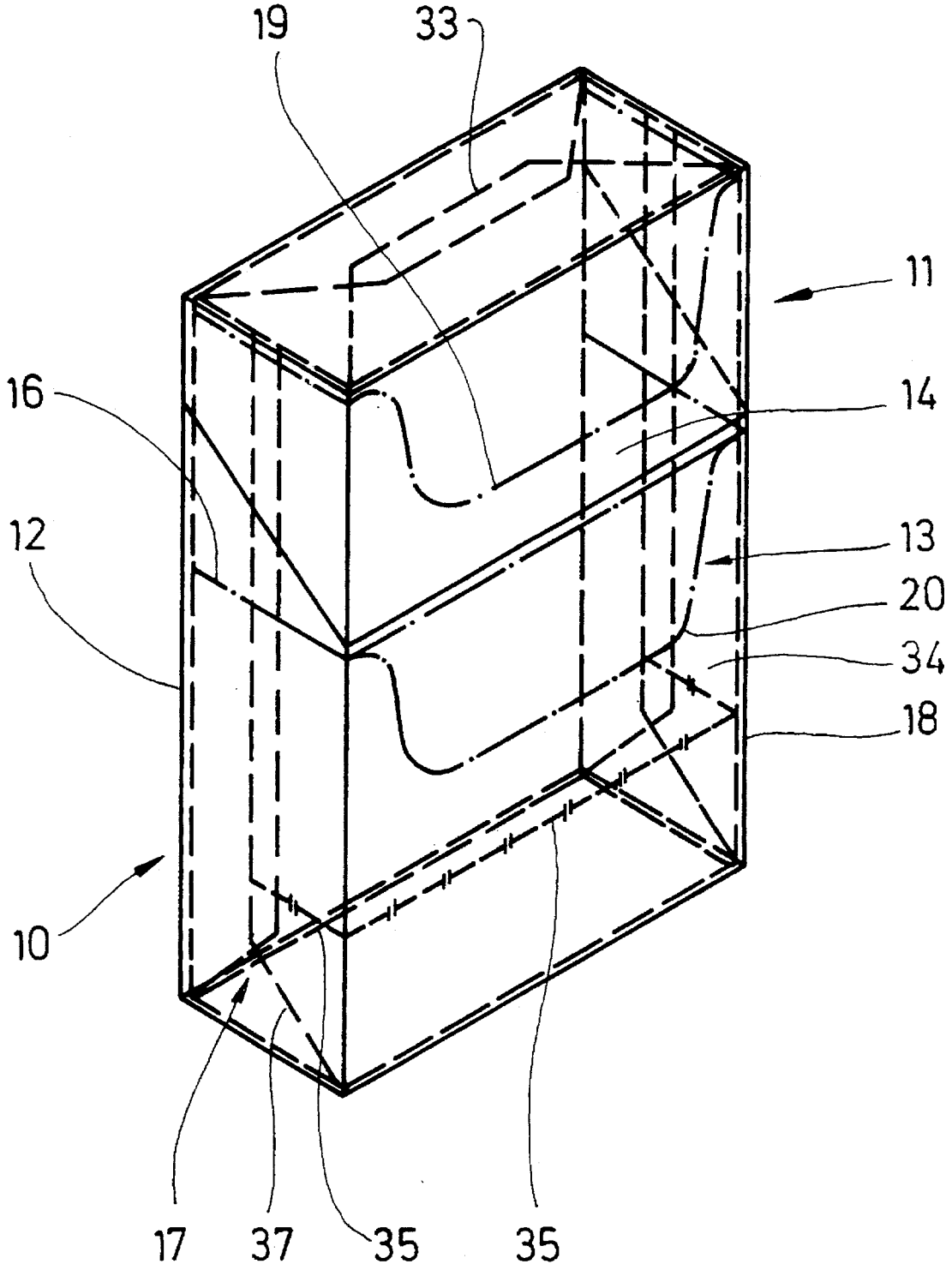
FIG. 1 shows a perspective view of a hinge-lid packet.
Figure 2:
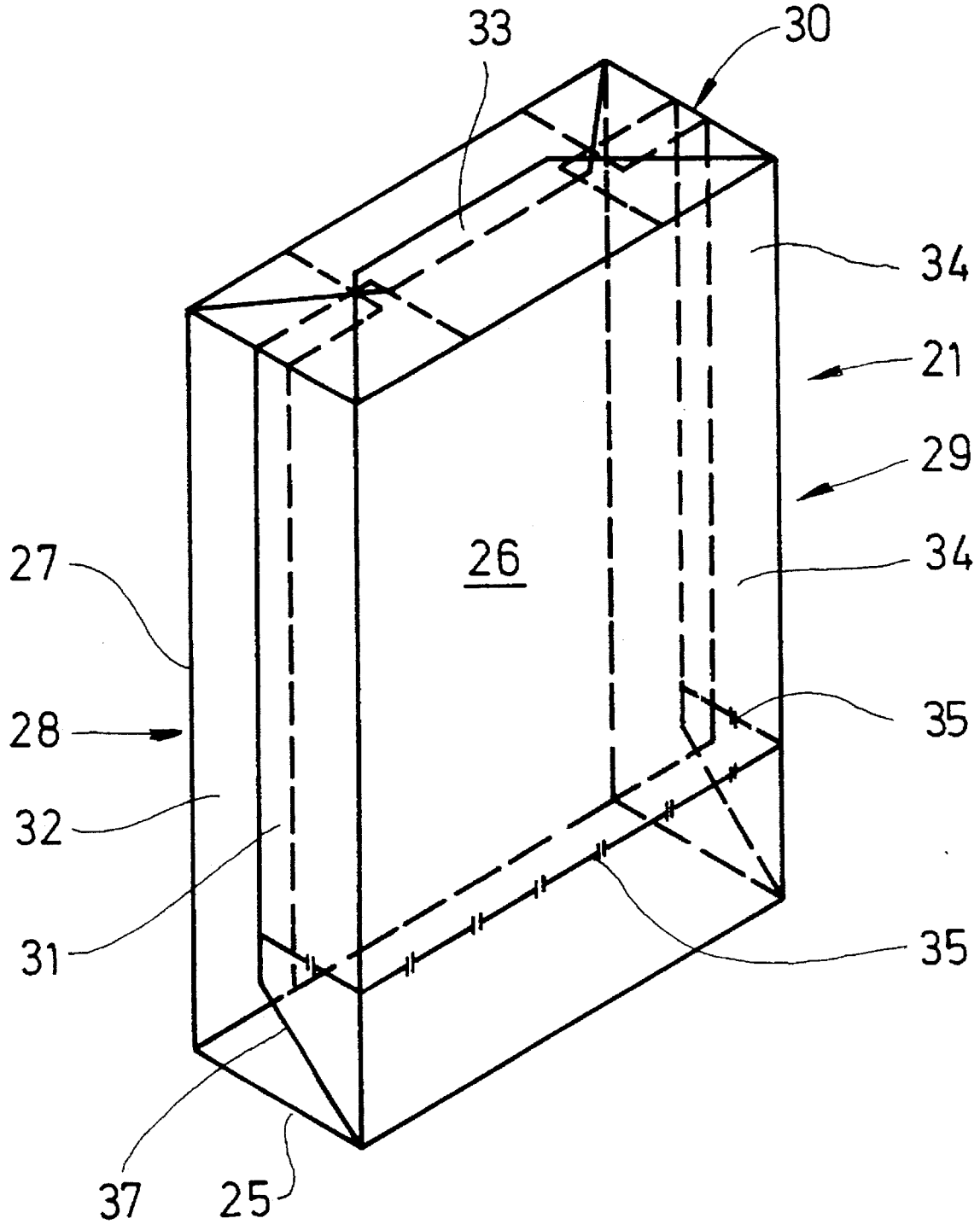
FIG. 2 shows a ready-folded inner wrapping of a hinge-lid packet, likewise in a perspective representation.
Figure 3:
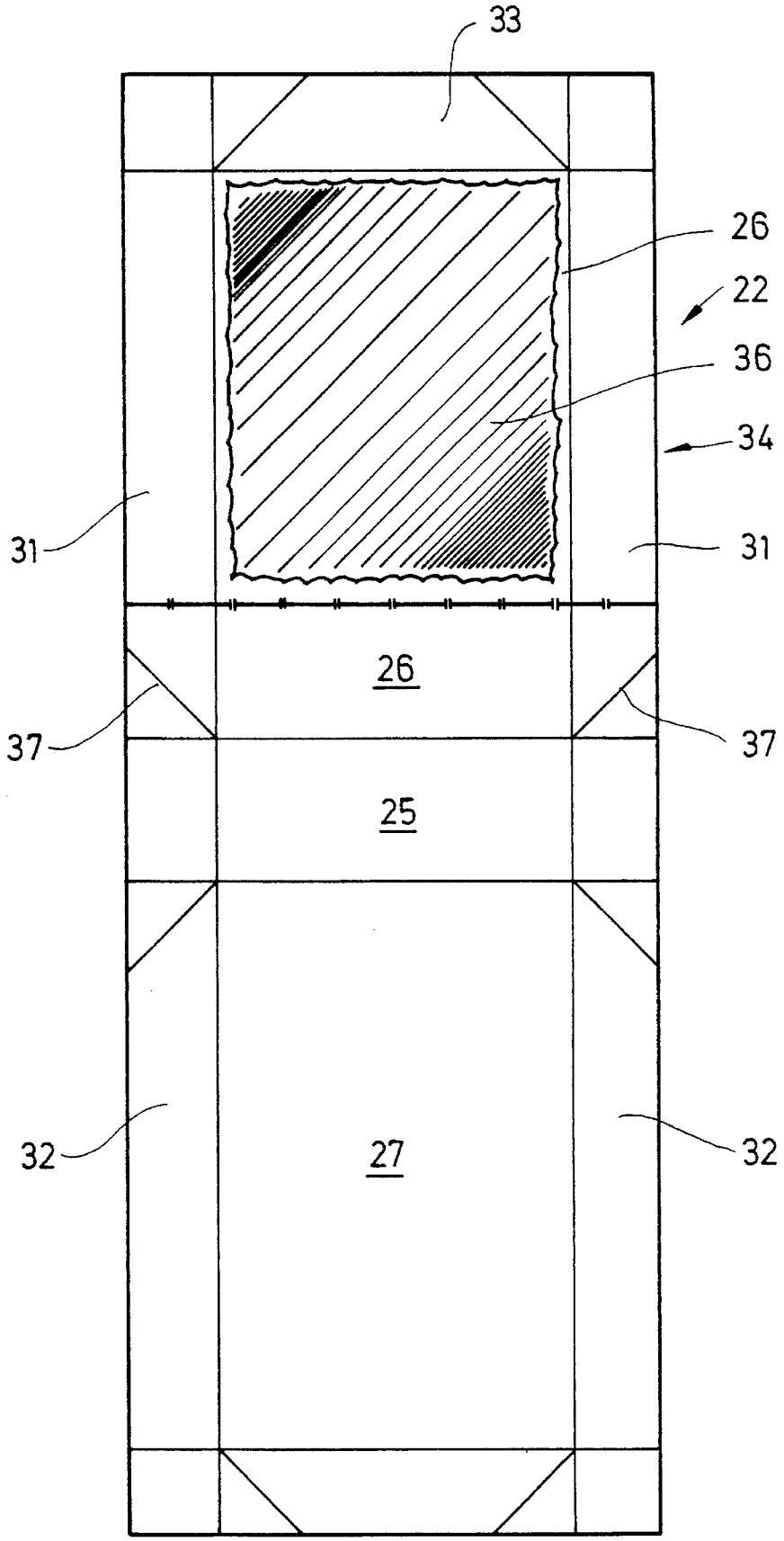
FIG. 3 shows a spread-out blank for an inner wrapping.

The particulars illustrated in the drawings are concerned with the design of a hinge-lid packet for cigarettes. This consists conventionally of a lower packet part 10 and of a lid 11. The latter is connected pivotally to the packet part 10 in the region of a rear wall 12.

Located inside the hinge-lid packet is a collar 13. This is designed so that a collar front wall 14 bears with a lower part region against the inner face of a packet front wall 15 of the packet part 10 and is connected to the packet front wall 15. Collar side tabs 16 are located in the region of packet side walls 17, 18 of the pack. The collar 13 is seated with a lower region in the packet part 10. The upper region projecting from the latter is surrounded by the lid 11 in the closing position. The collar front wall 14 is designed so that a recess 19 limited by curved contours is formed in the region of the collar front wall projecting from the packet part 10. The lower region of the collar front wall 14 in the packet part 10 is formed by an appropriately designed tongue 20.

The pack content, namely a cigarette group formed in the shape of a block, is surrounded by an inner wrapping 21. This consists of a blank 22 made of paper or paper-like material. In the present example, the blank 22 for the inner wrapping is severed from a material web 23 in the region of a packaging machine. The material web 23 is rolled up to form a reel 24.

The inner wrapping 21 surrounds the cigarette group on all sides. The blank 22 is folded in such a way that a closed bottom wall 25, a front wall 26, a corresponding rear wall 27, side walls 28, 29 and an end wall 30 are formed. The side walls 28, 29 of the inner wrapping 21 consist of side tabs 31, 32 folded trapezoidally in the lower region, namely adjacent to the bottom wall 25. These partially overlap one another. The side tab 31 facing the front wall 26 or connected to this is located on the outside.

The end wall 30 too is formed by folding tabs. A trapezoidal outer longitudinal tab 33 adjoins the front wall 26 in the region of the end wall 30.

The upper part of the front wall 26 of the inner wrapping 21 is designed as a pull-off flap 34. This is limited by a lower transversely directed perforation line 35 which extends continuously in the region of the front wall 26 and of the adjoining side tab 31. When the hinge-id packet is used, the pull-off flap 34 is removed, namely pulled out of the open packet part 10. For this purpose, the pull-off flap 34 is grasped in the region of the longitudinal tab 33 of the end wall 30 and is pulled upwards. The perforation line 35 is thereby severed.

The pull-off flap 34 is provided with a printed image 36 which, in the present exemplary embodiment, extends over the entire front wall 26 of the pull-off flap 34 on the front side of the latter. The printed image 36 can be advertising information. Preferably, however, the printed image 36 is intended as a voucher, a certificate of participation in competitions or the like.

In the present exemplary embodiment, the pull-off flap 34 is made markedly larger than usual. For this purpose, the perforation line 35 is located below the collar 13 or below the tongue 20 of the collar front wall 14. The possible lower position of the perforation line 35 is defined by an oblique edge 37 which is formed in the region of the side tabs 31, 32. The perforation line 35 is located at a (short) distance above the upper end of this oblique edge 37. As result of this design of the pull-off flap 34, a larger area of the front wall 26 is available for the printed image 36. If the inner wrapping is folded on the 'bottom-folding' principle, the oblique edge is absent in the region of the side walls. In this case, the flap can also extend directly as far as the bottom wall.

Figure 4:
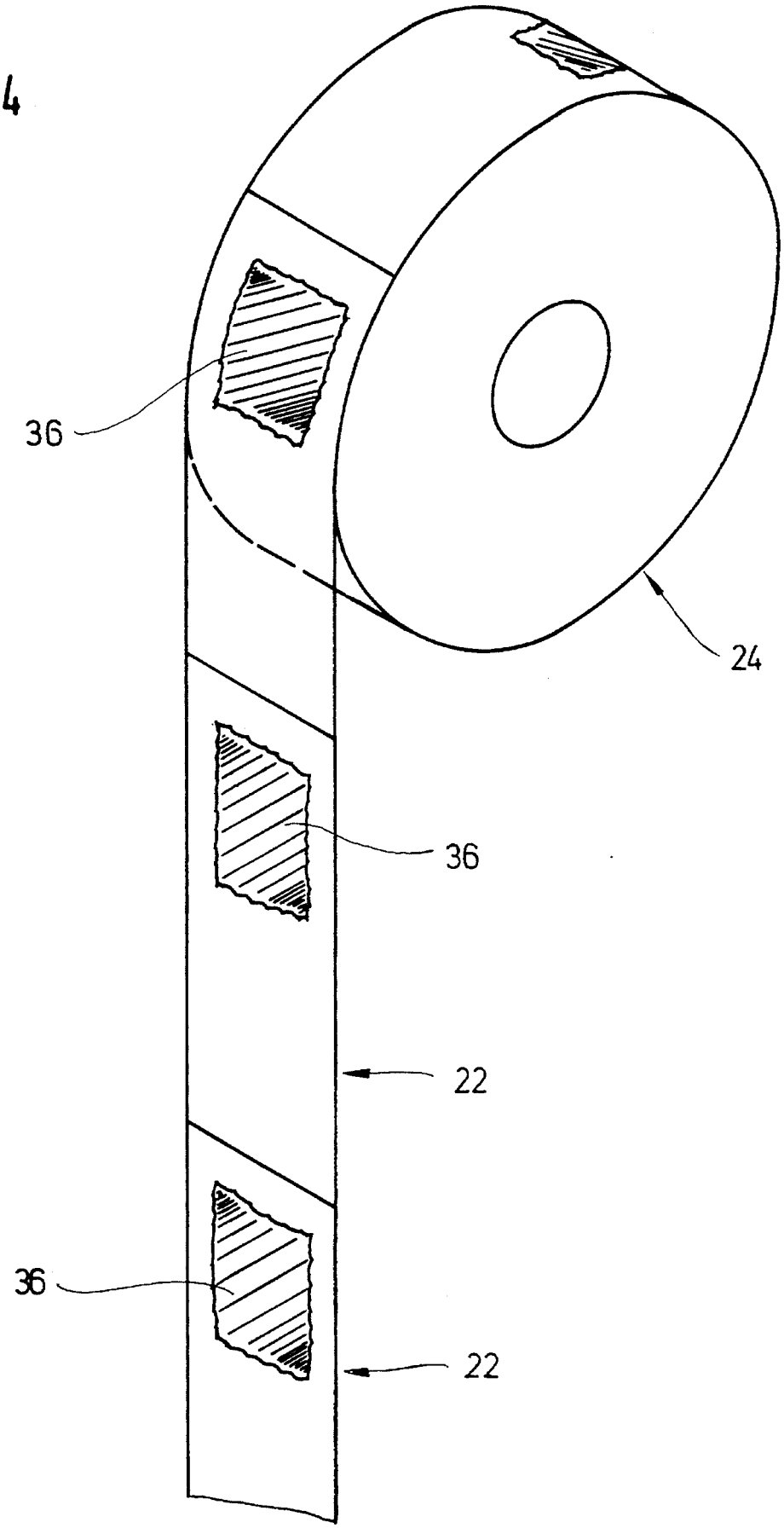
FIG. 4 shows a rolled-up material web for blanks according to FIG. 3.

As is evident especially from FIG. 4, the printed image 36 is expediently already applied to the material web 33 in the correct position for the blanks 22. The material web 23 can thereby be processed in a packaging machine in the customary way.

Figure 5:
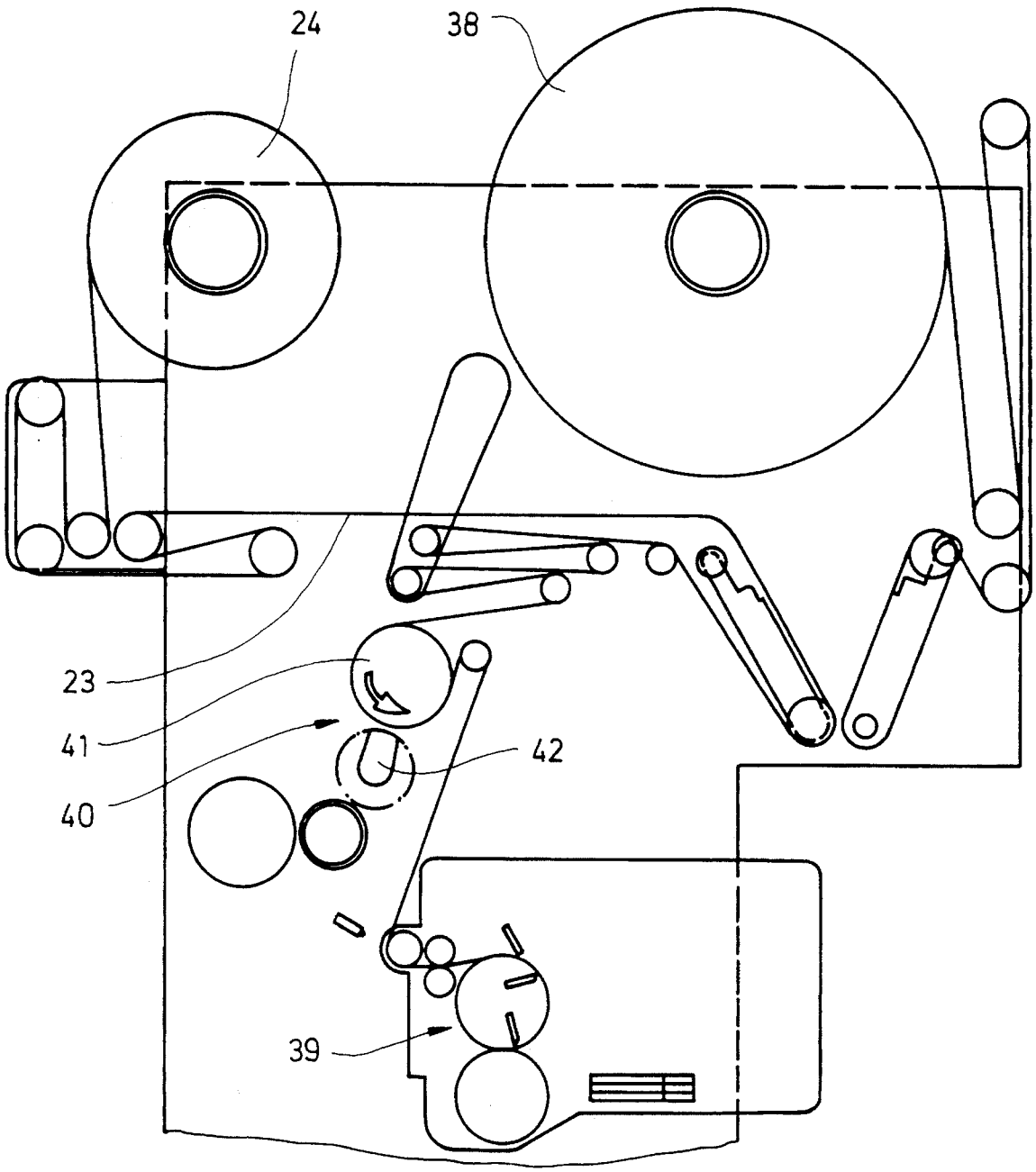
FIG. 5 shows a diagrammatic side view of parts of a packaging machine for the production of blanks.

FIG. 5 shows diagrammatically particulars of a packaging machine of this type, with a reel 24 for the running-off material web 23 and with a replacement reel 38 to be connected after the latter has been used up. The material web 23 runs over a multiplicity of deflecting rollers as far as a severing station 39. Here, the blanks 22 are severed from the material web and are supplied for the wrapping of a cigarette group.

The severing station 39 is followed in the conveying direction of the material web 23 by a marking station or a printing unit 40. The function of the printing unit 40 is to apply the printed image 36 or additional markings, critical for the validity of a voucher or the like, in the region of the printed image 36. For this purpose, the printing unit 40 consists of a control roller 41 which conveys the material web 23 in the correct position in accordance with conventional printing marks. The control roller 41 is assigned a rotating printing head 42 which applies the printed image 36 or the additional markings to the latter. This guarantees that only pull-off flaps 34 originating from a pack can be used for the intended purpose.

I claim:

1. A package for a group of cigarettes including an inner wrapper and a box, said box including a front wall, a rear wall, side walls, and top and bottom walls, said box being closed by a lid hinged to said rear wall, said lid, in a closed condition of said box, providing a continuation of said front wall of said box, the improvement comprising:

said wrapper being comprised of at least one length of wrapping material sufficient to encircle said group of cigarettes, and including a removable pull-off flap, said pull-off flap having a printed image, positioned thereon.

said pull-off flap being integral with said wrapper, and being separable therefrom at a line of perforations extending transversely of the length of said wrapper, and located at a position adjacent said bottom wall of said box when said wrapped said group of cigarettes is housed in said box.

2. The package of claim 1, in which said printed image occupies the entire extent of said pull-off flap.

3. The package of claim 1, in which said line of perforations is positioned closely adjacent oblique folded edges of said wrapper produced in folding said wrapper around said group of cigarettes, said oblique edges, when said group of wrapped cigarettes is housed in said box commencing at said bottom wall of said box.

4. The package of claim 1, in which said pull-off flap is located below an upper edge of a tongue of said front wall.

* * * * *